United States Patent [19]

Fitzgerald

[11] Patent Number: 4,746,122

[45] Date of Patent: May 24, 1988

[54] HANG-UP TOY PUZZLE GAME

[76] Inventor: Henry F. Fitzgerald, 277 Belfort St., Jacksonville, Fla. 32204

[21] Appl. No.: 77,756

[22] Filed: Jul. 27, 1987

[51] Int. Cl.[4] ..... A63F 9/08

[52] U.S. Cl. ..... 273/153 R; 273/1 G; 273/158

[58] Field of Search ..... 273/1 R, 1 G, 1 GF, 273/153 R, 158, 153 S

[56] References Cited

U.S. PATENT DOCUMENTS

| | | | |
|---|---|---|---|
| 1,467,736 | 9/1923 | Owen | 74/545 |
| 1,753,700 | 4/1930 | Graff et al. | 74/545 |
| 2,712,444 | 7/1955 | Reed | 273/1 GG |
| 3,106,039 | 10/1963 | Simpson | 273/1 G X |
| 3,414,265 | 12/1968 | Marks | 273/1 GG X |

FOREIGN PATENT DOCUMENTS

| | | | |
|---|---|---|---|
| 12573 | of 1889 | United Kingdom | 273/158 |
| 355101 | 8/1931 | United Kingdom | 74/545 |

*Primary Examiner*—Anton O. Oechsle
*Attorney, Agent, or Firm*—Arthur G. Yeager

[57] ABSTRACT

A toy puzzle in the form of two shaped semi-rigid wire members, the first member serving as a handle and a support from which the second member may be hung in a variety of positions, depending on the skill of the holder of the first member. The first member is in the form of a Z-shaped member with a relatively short straight leg section joined to a relatively long leg section by a mid-section oriented at an acute angle to both leg sections, all sections lying in a common plane, and the free end of the long leg section having a grip and serving as a handle. The second member is formed of two opposed hook sections joined by straight sections bent at various angles, with all sections lying in a common plane and with the free ends of each hook section being bent in opposed directions from the common plane.

7 Claims, 2 Drawing Sheets

HANG-UP TOY PUZZLE GAME

CROSS-REFERENCE TO RELATED APPLICATION

This application relates to the same invention as my prior application Ser. No. 807,787, filed June 20, 1977, now abandoned.

BACKGROUND OF THE INVENTION

The invention relates to toy puzzle games primarily employing two wire members manipulative with respect to each other.

There have been many types of games employing various types of elements that are manipulative with each other. The only prior art known to me are the references cited in my prior application above, namely U.S. Pat. Nos. 2,712,444 to Reed, 3,106,039 to Simpson and 3,414,265 to Marks; and G.B. Pat. No. 12,513 to Western. None of these prior art references suggest or disclose my invention as herein disclosed and claim nor do the prior art elements manipulate in the same or similar fashions to the puzzle game described herein.

SUMMARY OF THE INVENTION

The invention is directed to a toy puzzle in the form of two shaped semi-rigid wire members, with the first member serving as a handle and support from which the second member may be hung in a variety of positions, depending on the skill of the holder of the first member. The first member is in the form of a Z-shaped member with a relatively short straight leg section joined to a relatively long leg section by a mid-section oriented at an acute angle to both leg sections and all sections lying in a common plane, and the free end of the long leg section serving as a handle. The second member is formed of two opposed hook sections joined by straight sections bent at various angles, with all sections lying in a common plane and the free ends of each hook section being bent in opposed directions from the common plane.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DESCRIPTION OF THE PREFERRED EMBODIMENT

Figure 1:
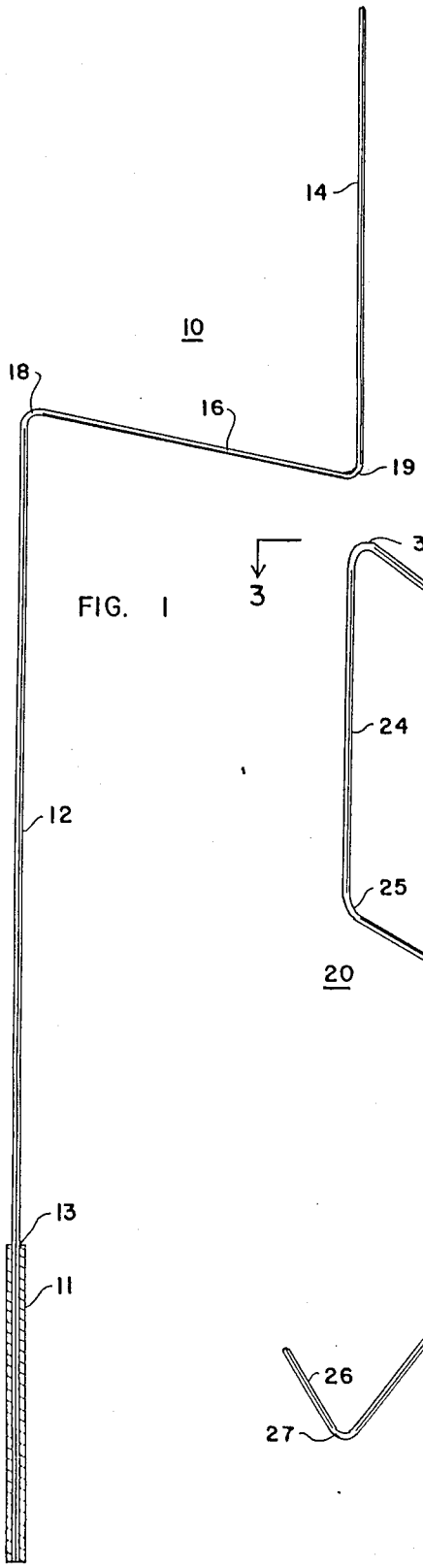
FIG. 1 is a front elevational view of the handle member.
Figure 3:
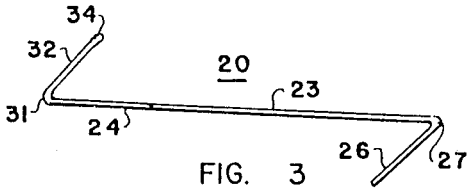
FIG. 3 is a top plan view of the hanging member, taken along line 3—3 of FIG. 2.
Figure 2:
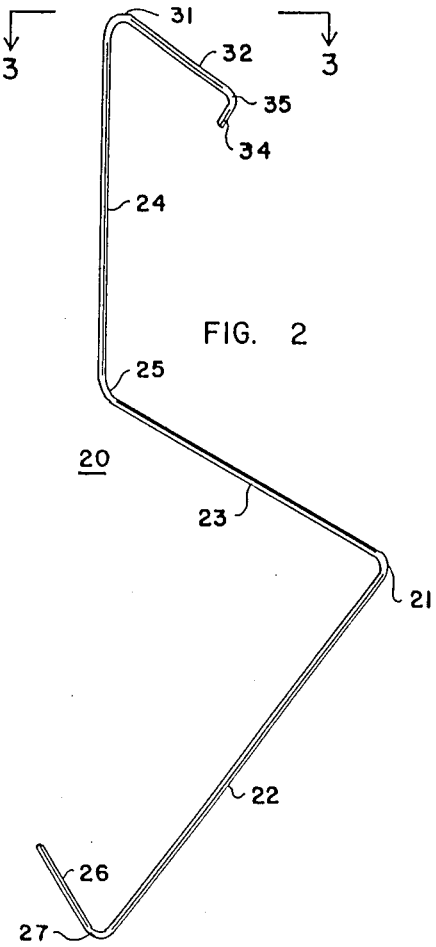
FIG. 2 is a front elevational view of the hanging member.

Referring now more specifically to the drawings, in which similar reference characters denote similar elements throughout the several views, FIG. 1 illustrates the handle member 10 from which the hanging member 20 shown in FIGS. 2, 3, is suspended in the sequential steps shown in FIGS. 4–13 in the solving of the puzzle, with handle member gripped manually by grip 11 and manipulated so as to shift the hanging member from position to position.

Handle member 10 is shaped generally as a Z and formed of a straight long leg 12, with a grip 11 fixed to the free end section 13 of leg 12, a straight short leg 14, generally parallel to leg 12 and a straight mid-section 16 that joins legs 12 and 14 at an acute angle to each joined leg 12, 14 at rounded corner sections 18 and 19 respectively, with legs 12, 14 and mid-section 16 extending in a common plane.

Figure 4:
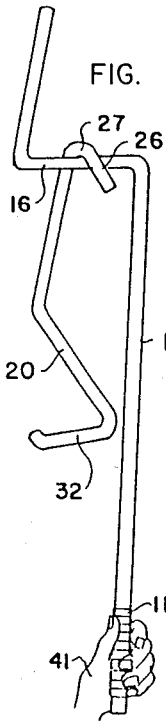
FIGS. 4–13 are each elevational views of the sequential positions of the hanging member being suspended from the handle member.

Hanging member 20 is formed of a first leg 22 joined at rounded corner 21 to a second leg 23 that extends from leg 22 at an acute angle greater than 75 degrees to join a third leg 24 at rounded corner 25, with leg 24 extending at an obtuse angle greater than one hundred and five degrees from leg 23 and away from the axis of leg 22. Legs 22, 23 and 24 extend in a common plane. Leg 22 terminates at rounded corner 27 in a first hook section 26 that extends in a straight line at an acute angle, from leg 22. Leg 24 terminates at rounded corner 31 in a second hook section 32 that extends in a straight line at an acute angle from leg 24 to terminate in a tip section 34 that extends at an obtuse angle from hook section 32 towards leg 23. Tip section 34 distinguishes sections 32 from 26 so that the start of the game puzzle will begin as shown in FIG. 4. Hook section 26 extends at a slight acute angle to the plane of legs 22, 23 and 24 in a first direction with hook section 32 extending at a slight acute angle to said plane in a second direction opposed to said first direction so that the two hook sections extend in opposed directions from said common plane.

Figure 5:
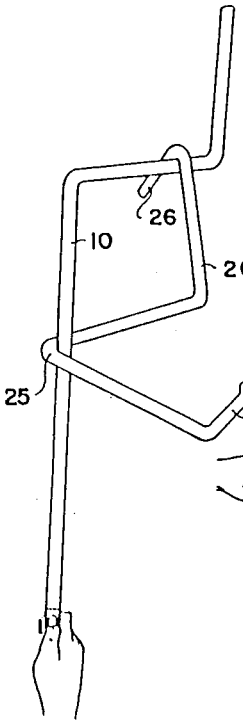
Figure 6:
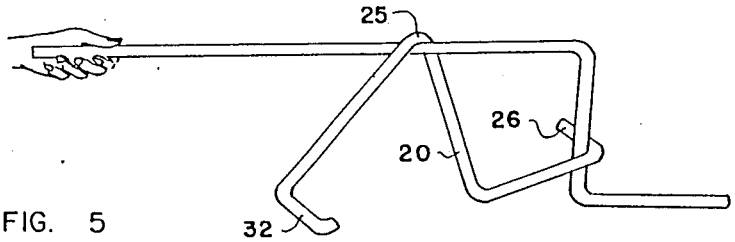
Figure 7:
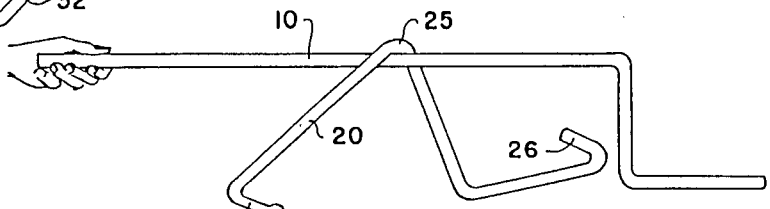
Figure 8:
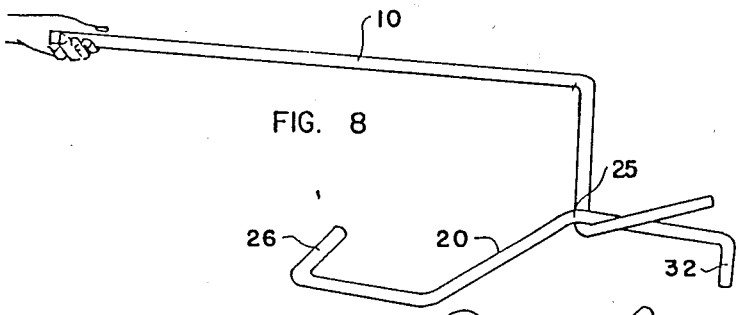
Figure 9:
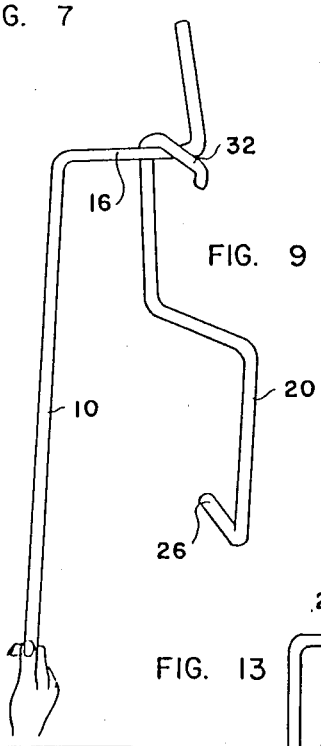
Figure 10:
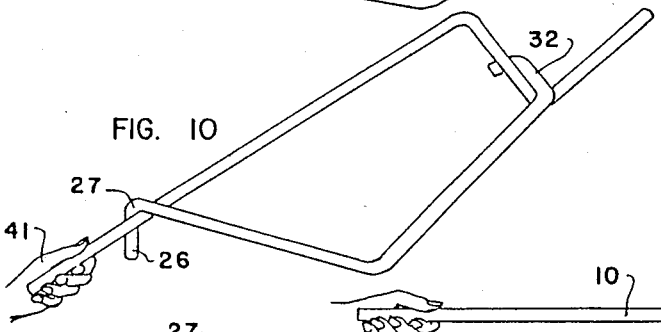
Figure 11:
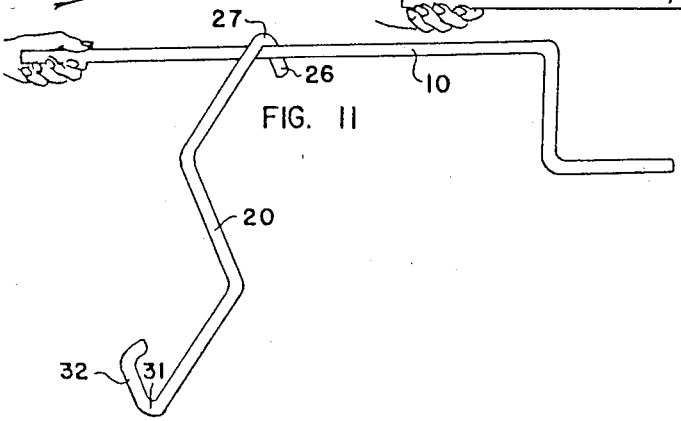
Figure 12:
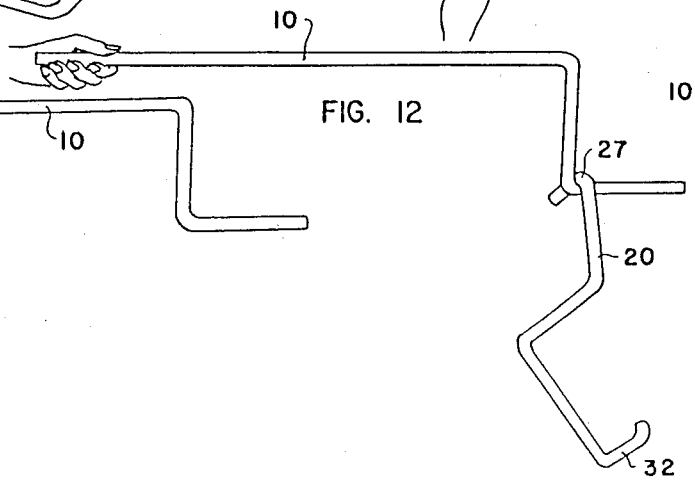
Figure 13:
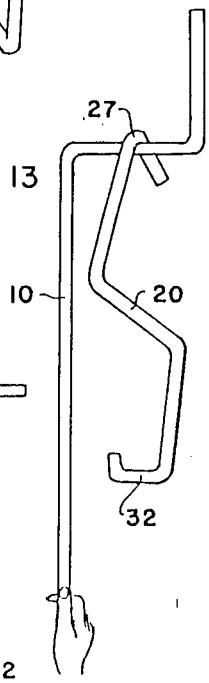

The object of the game is for a player holding handle grip 11 with one hand 41 to start with corner section 27 of hanging member 20 suspended from mid-section 16 of handle member 10 and to then manipulate handle member 10 so as to rotate hanging member 20 as shown in FIGS. 5–7 until hanging member 20 is supported from leg section 12 by corner section 25 until as shown in FIGS. 8–9, hanging member 20 is rotated to be suspended from intermediate section 16 by opposed corner section 32. The game is continued as shown in FIGS. 10–12 until as shown in FIG. 13 the hanging member 20 is again suspended in the original position of FIG. 1.

Hanging member 20 is of shorter overall length than leg 12 of handle member 10 with both members preferably being formed of round wire of a uniform diameter.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

I claim:

1. A puzzle game comprising a shaped wire hanging member suspended in various positions from a shaped wire handle member, said handle member being shaped in the form of two spaced parallel leg sections joined by a straight mid-section oriented at an acute angle to both leg sections and with all said sections lying in a first common plane, said hanging member being formed of a length of wire bent as a plurality of straight sections joined to each other by curved corner sections, all of said straight sections of said hanging member having respective axes lying in a second common plane, said hanging member having opposed free ends each terminating in a hook section oriented at an acute angle to said second common plane, each said hook section extending at an acute angle and in an opposite direction to said second common plane.

2. The game as defined in claim 1 wherein one of said hook sections is formed with a bent tip so as to distinguish said hook sections from each other.

3. The game as defined in claim 1 wherein said mid-section being located in an intermediate location along the longitudinal axis of said handle member, each of said spaced leg sections extending substantially beyond, and in a direction away from said mid-section in the direction of said longitudinal axis of said handle member so that said hanging member may be freely suspended from either leg section in a plane generally perpendicular to each said leg section.

4. A puzzle game comprising a shaped wire hanging member and a shaped wire handle member, said hanging member being suspended in various positions from said handle member, said handle member being shaped in the form of two spaced substantially parallel leg sections joined by a substantially straight mid-section oriented at an acute angle to both said leg sections and with all said sections lying in a common plane, said mid-section being located in an intermediate location along the longitudinal axis of said handle member, each of said spaced leg sections extending substantially beyond, and in a direction away from said mid-section in the direction of said longitudinal axis of said handle member so that said hanging member may be freely suspended from either leg section in a plane generally perpendicular to each of said leg sections and without striking said mid-section or the other of said leg sections when so suspended.

5. The game as defined in claim 4 wherein each said leg section includes a free end portion, a handle grip fixed about said free end portion of one of said leg sections manually gripping thereof by a user in playing said game.

6. The game as defined in claim 4 wherein said hanging member is formed of a length of wire bent as a plurality of straight sections joined to each other by curved corner sections, all of said straight sections of said hanging member having respective axes lying in another common plane, said hanging member having opposed free ends each terminating in a hook section oriented at an acute angle to said other common plane, each said hook section extending at an acute angle and in an opposite direction to said other common plane.

7. The game as defined in claim 6 wherein one of said hook sections is formed with a bent tip so as to distinguish said two hook sections from each other.

* * * * *